US008890357B2

(12) United States Patent
Campbell

(10) Patent No.: US 8,890,357 B2
(45) Date of Patent: Nov. 18, 2014

(54) BATHING SYSTEM TRANSFORMER DEVICE WITH FIRST AND SECOND LOW VOLTAGE OUTPUT POWER CONNECTIONS

(75) Inventor: Graham J. Campbell, Stevenson Ranch, CA (US)

(73) Assignee: Balboa Water Group, Inc., Tustin, CA (US)

( * ) Notice: Subject to any disclaimer, the term of this patent is extended or adjusted under 35 U.S.C. 154(b) by 527 days.

(21) Appl. No.: 13/165,706

(22) Filed: Jun. 21, 2011

(65) Prior Publication Data

US 2012/0182114 A1 Jul. 19, 2012

Related U.S. Application Data

(63) Continuation-in-part of application No. 13/007,915, filed on Jan. 17, 2011.

(51) Int. Cl.

| | |
|---|---|
| ***H01F 27/29*** | (2006.01) |
| ***H01F 38/24*** | (2006.01) |
| ***H01F 27/02*** | (2006.01) |
| *A61H 33/00* | (2006.01) |
| *A61H 33/02* | (2006.01) |

(52) U.S. Cl.

CPC ..... *H01F 27/02* (2013.01); *A61H 33/00* (2013.01); *A61H 33/02* (2013.01); *H01F 38/24* (2013.01); *A61H 33/005* (2013.01); *Y10S 707/99933* (2013.01)

USPC ..... 307/38; 323/239; 363/21.08; 363/89; 4/541.2; 4/541.4; 4/541.1; 700/300; 707/999.003; 707/E17.032; 307/39; 219/492; 219/494; 250/231.19

(58) Field of Classification Search

CPC ... A61H 33/00; A61H 33/005; A61H 33/002; H01F 27/02; H01F 38/24

USPC ..... 307/38, 17, 29; 315/292; 333/101; 323/267

See application file for complete search history.

(56) References Cited

U.S. PATENT DOCUMENTS

| | | | | |
|---|---|---|---|---|
| 5,079,784 | A * | 1/1992 | Rist et al. | 4/541.2 |
| 5,361,215 | A | 11/1994 | Tompkins et al. | |
| 5,747,973 | A | 5/1998 | Robitaille et al. | |
| 6,084,783 | A | 7/2000 | Rascon Martinez et al. | |
| 6,407,469 | B1 * | 6/2002 | Cline et al. | 307/11 |

(Continued)

*Primary Examiner* — Hal Kaplan
*Assistant Examiner* — Elim Ortiz
(74) *Attorney, Agent, or Firm* — Larry K. Roberts

(57) ABSTRACT

A line voltage transformer device for a bathing installation includes a housing structure, with a line voltage electrical power connection including a line voltage wiring cable having an electrical connection at a distal end for connection to a line voltage AC supply outlet adjacent the bathing installation. A voltage transformer circuit is disposed within the housing and connected to the line voltage electrical power connection and is configured to transform AC line voltage electrical power from the line voltage electrical power connection to low voltage AC power at first and second low voltage AC terminals, wherein the low voltage AC power is delivered to the first and second low voltage AC terminals. A first low voltage wiring connection set is attached to the first and second low voltage AC terminals, the first wiring set including a first low voltage outlet connector for electrical connection to a first separate low voltage bathing installation device to provide low voltage AC power to the first separate device. A second low voltage wiring set is attached to the first and second low voltage AC terminals, the second wiring set including a second low voltage connector for connection to a second separate low voltage bathing installation device to provide low voltage AC power to the second separate device.

13 Claims, 10 Drawing Sheets

(56) References Cited

U.S. PATENT DOCUMENTS

| | | | | |
|---|---|---|---|---|
| 6,775,159 | B2 | 8/2004 | Webb et al. | |
| 2002/0122326 | A1 | 9/2002 | Chen et al. | |
| 2002/0125772 | A1 | 9/2002 | Kemp | |
| 2005/0213300 | A1* | 9/2005 | Tran et al. | 361/685 |
| 2007/0222399 | A1* | 9/2007 | Bondy et al. | 315/291 |

* cited by examiner

BATHING SYSTEM TRANSFORMER DEVICE WITH FIRST AND SECOND LOW VOLTAGE OUTPUT POWER CONNECTIONS

This application is a continuation-in-part of U.S. application Ser. No. 13/007,915, filed Jan. 17, 2011, the entire contents of which are hereby incorporated by reference.

BACKGROUND

Bathing installations, such as spas and whirlpool baths, typically include several electrical devices or systems, powered by line voltage. Connecting these devices to pre-installed power outlets can present problems, since the existing outlets may not be closely located relative to the devices, and may be limited in number.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
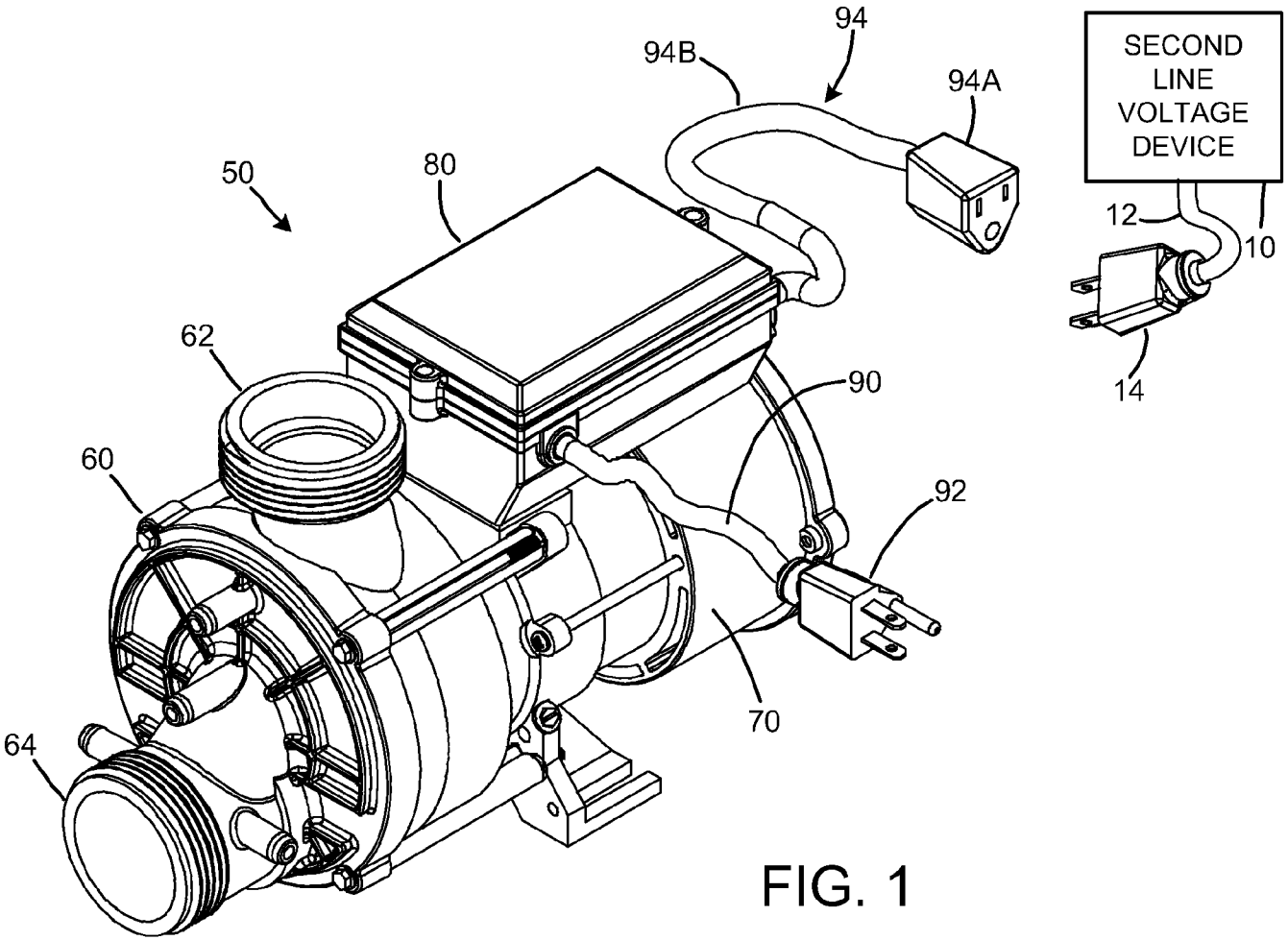
FIG. 1 is an isometric view of an exemplary embodiment of a bathing installation water pump with an auxiliary power connection.

In the following detailed description and in the several figures of the drawing, like elements are identified with like reference numerals. The figures are not to scale, and relative feature sizes may be exaggerated for illustrative purposes.

Figure 2A:
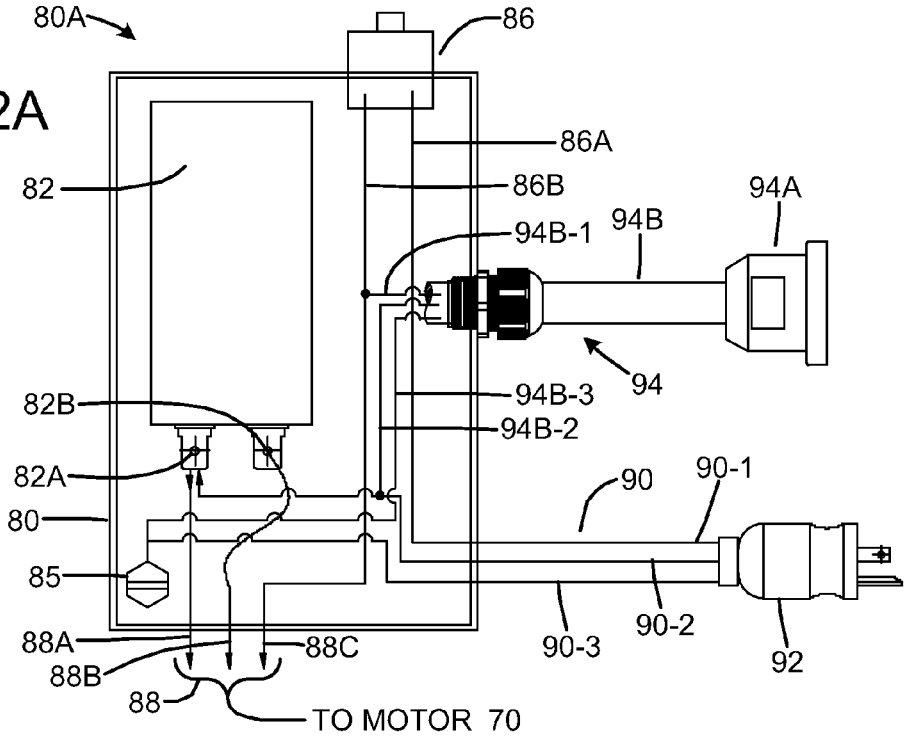
FIG. 2A is an exemplary schematic wiring diagram illustrating one exemplary power connection configuration for the pump of FIG. 1A.
Figure 2B:
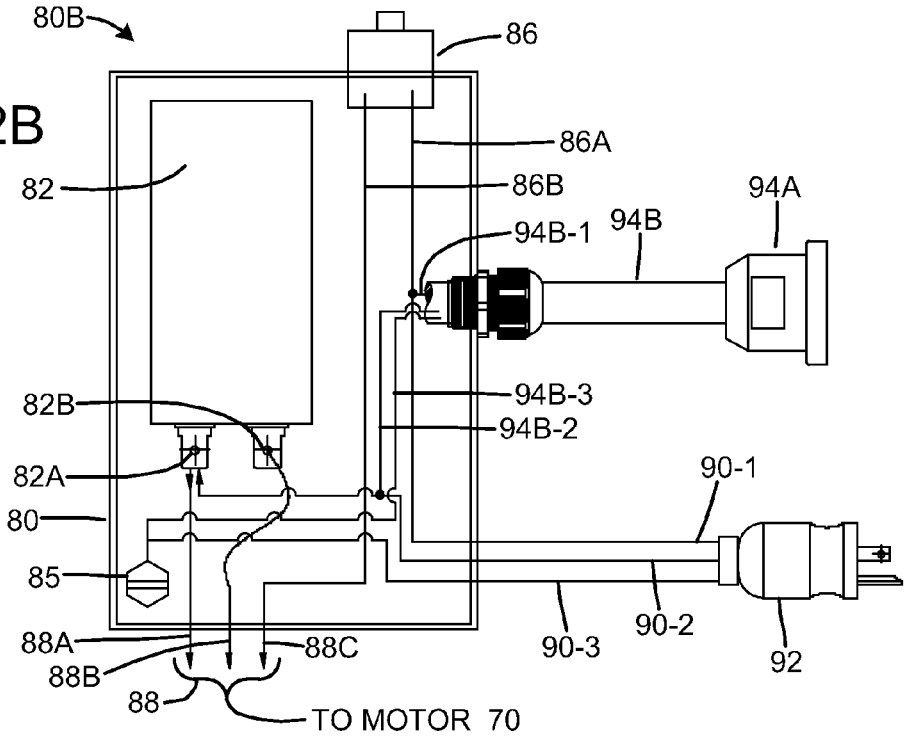
FIG. 2B is an exemplary schematic wiring diagram illustrating another exemplary power connection configuration for the pump of FIG. 1A.
Figure 2C:
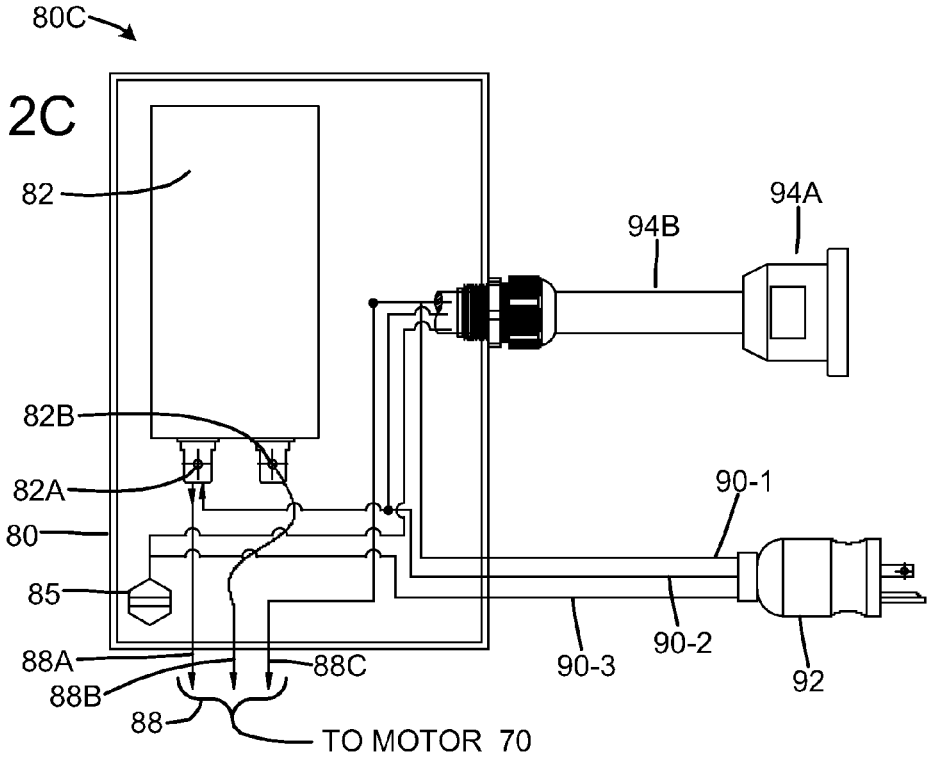
FIG. 2C is an exemplary schematic illustrating another exemplary power connection configuration for the pump of FIG. 1A.

FIGS. 1-2C illustrate an exemplary embodiment of a bathing system load device equipped with an auxiliary line voltage outlet or connector, to allow the load device to power another line voltage device or load. This exemplary load device 50 is a water pump system, including a pump 60 with a water inlet port 64 and a water outlet port 62, integrated or assembled to an electric motor 70. The motor shaft (not shown in FIG. 1) is coupled to an impeller (not shown in FIG. 1) of the pump to drive the pump to pump water entering the inlet port from a conduit through the pump and out the outlet port to an outlet conduit forming a part of the water flow path of the bathing installation. Electrical power to the motor is provided by wiring 90 and connector plug 92, which is configured for connection to a line voltage outlet adjacent the bathing installation. For some application, the connector plug 92 is omitted, and the distal end of the wiring 90 hardwired directly to a line voltage source, e.g. at a wall junction box. To the extent just described, the pump system 50 is conventional.

In accordance with an aspect of the invention, the pump system 50 is provided with an auxiliary line voltage power outlet 94, powered from electrical power received from the power source through the primary power wiring 90 and connector plug 92. In this exemplary embodiment, the auxiliary power connection 94 is configured as a "pigtail" connector with wiring 94B and connector 94A. In this embodiment, the auxiliary power connector may be used to electrically power a second line voltage device 10, through wiring 12 and connector 14 configured to mate with auxiliary power connector 94A. For example, an ozone generator or bathing installation lighting may be connected to the auxiliary power connection 94. The total electrical load presented to the line voltage power outlet should not exceed the rated load for the power outlet. If the power outlet is rated at 15 A, then the total current draw by both the pump 50 and the second device 10 should not exceed 15 A.

The pump system 50 includes an electrical module or junction box 80 in which is mounted the electrical wiring circuitry for providing electrical power to the motor and connecting the auxiliary outlet to the voltage at the power inlet to the motor. There are several alternatives to the state of the auxiliary power outlet 94. The auxiliary power outlet can be wired to be "live" or connected to power when the pump is turned on, e.g. by switching the power outlet to which the primary electrical connector 92 is connected. Another alternative is for the circuitry to provide that the auxiliary power outlet is live at all times power is live and connected to the pump primary power connector 92, even when the pump is turned off by a separate switch. A further alternative is for the auxiliary outlet to be live only when the pump is turned on, i.e. so that the auxiliary outlet is turned on and off with the pump motor.

Figure 1A:
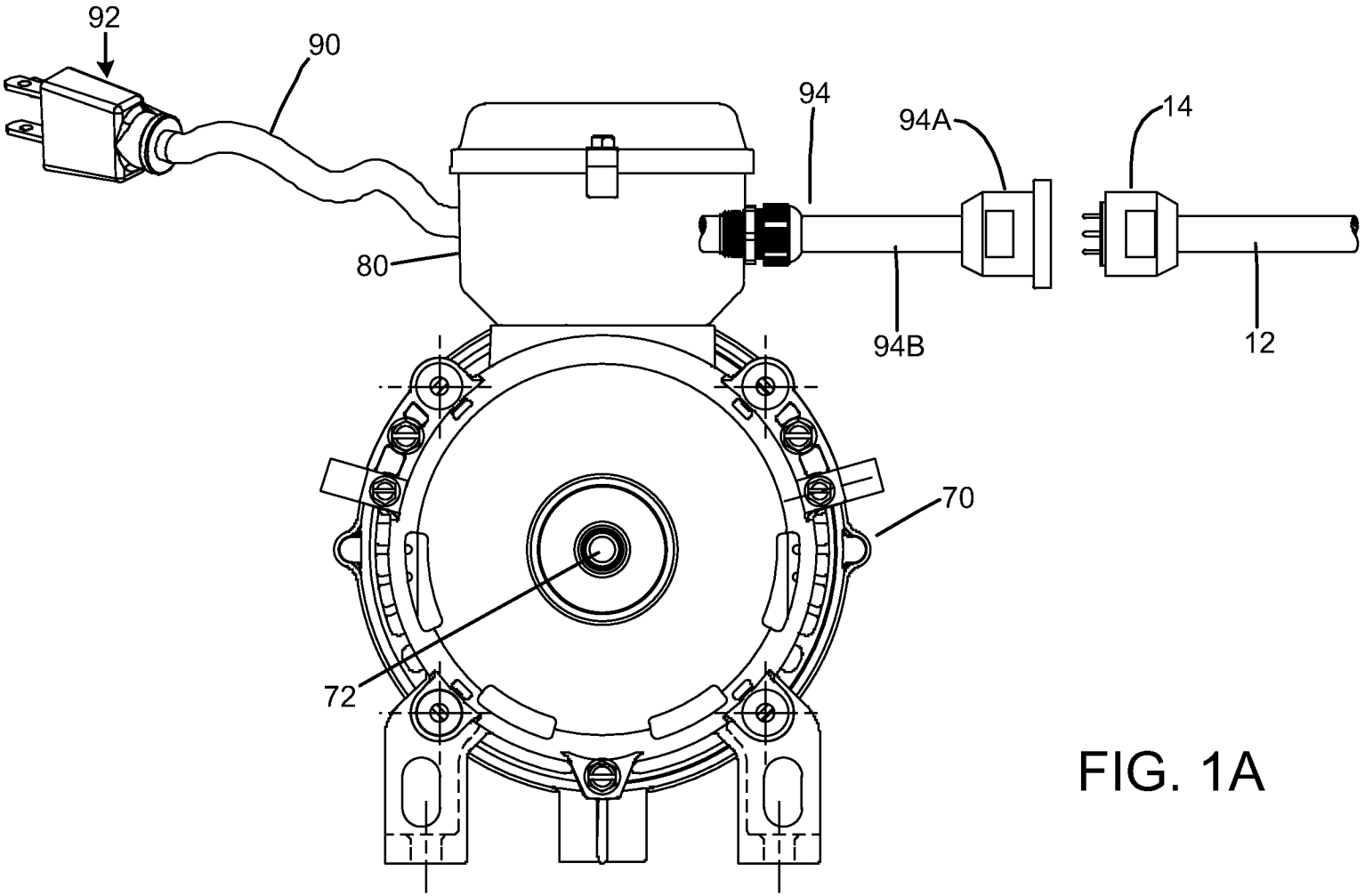
FIG. 1A is a front view of an exemplary bathing installation pump with an auxiliary power connection.

FIG. 1A is a front view of an exemplary embodiment of the motor 70 of the pump system 50 of FIG. 1, with the pump 60 removed. The motor shaft 72 is visible in FIG. 1A. FIG. 1A shows the electrical module box 80, the primary power connection comprising the wiring 90 and connector 92, for connection to the line voltage connector, and the auxiliary power connection 94, with the wiring 94B and connector 94A. The connector 14 and wiring 12 for the second line voltage system 10 is also visible in FIG. 1A.

FIGS. 2A-2C illustrate several exemplary, alternate wiring circuit configurations for connecting the auxiliary power connection to the primary power connection. The wiring configurations are implemented by wiring within the module box 80 in this example. It will be seen that, in these examples, each wiring circuit in box 80 includes a capacitor 82 with terminals 82A and 82B. The use of capacitors in bathing installation pump motor drive circuits is well known, and the box 80 is commonly referred to as the capacitor box.

FIG. 2A illustrates a wiring circuit configuration 80A in which the power connection to the pump motor 70 and to the auxiliary power connection 94 is controlled by an air switch receiver 86. Thus, the motor and the auxiliary power connection are switched together, so that power is applied to the auxiliary connection whenever power is applied to the motor 70. The switch receiver 86 is switched by a remote air switch actuator, typically located on a bathing installation panel adjacent the bathing tub and connected to the switch receiver by an air tubing (not shown). Suitable air switches are commonly commercially available, e.g., the series TBS air switch marketed by Teckmark Coroporation, 7745 Metric Drive, Mentor, Ohio 44060, described at www.tecmarkcorp.com/products/air-switches-tbs.php. Other air switches are available. In this case, the switch receiver includes two wire or terminal connections, 86A and 86B. Depending on the state of the switch receiver, continuity will either exist between 86A and 86B, or be interrupted, in which case 86B is open circuited relative to 86A.

In the exemplary embodiment shown in FIG. 2A, the primary power connection is a grounded, three-wire connection, with wire 90-1 a "hot" wire, wire 90-2 a "common" wire, and wire 90-3 a ground wire to be connected to the pump ground 85. Wire 90-1 is connected to switch wire 86A, and common wire 90-2 is connected to capacitor terminal 82A. The second switch wire 86B is provided as one output component of the motor drive signals 88 to be connected to the motor windings. Wires 88A and 88B are connected to the capacitor terminals 82A and 82B, respectively, and form the second and third output components of the motor drive signals. The capacitor 82 is used to assist in starting the motor 60. The motor 70 will be operated only when the switch receiver 86 provides continuity between its terminal wires 86A and 86B, connecting the "hot" lead from the power source to the motor drive.

Still referring to FIG. 2A, the auxiliary power connection is also a three-wire power connection, with wire 94B-1 a "hot" lead or wire, wire 94B-2 a common lead or wire, and wire 94B-3 a ground wire connected to the ground 85. The hot lead 94B-1 is connected to switch wire 86B. The common lead 94B-2 is connected to the capacitor terminal 82A. Thus, the hot lead 94B-1 of the auxiliary power connection will be live or hot only when the switch wire 86B is live or hot, and so the auxiliary power connection is switched on/off with the motor drive signals.

FIG. 2C illustrates an alternate circuit configuration 80C, in which the motor drive signals 88 are hot or energized at all times the primary power connection 90 and 92 is hot or active. This might be the case, for example, for an application in which the line voltage source outlet to which connector 92 is connected is a switched outlet, or to a bathing installation control box or spa pack for power connection through a relay or triac switch, for example. In this configuration, there is no air switch, and the hot leads of the primary and auxiliary power connections are connected together, with the motor drive hot component 88C live or turned off, depending on the state of the power applied to the primary power connection. As with the circuit configuration of FIG. 2A, the common leads of both the primary and auxiliary power connections are connected to terminal 82A of the capacitor 82. The components 88A and 88B of the motor drive signals 88 are the same as described above for the circuit configuration 80A of FIG. 2A.

Another exemplary alternate circuit configuration 80B is shown in FIG. 2B. In this wiring configuration, the pump motor 80 is controlled by an air switch receiver 86, to be either turned on or off depending on the switch state. Hot lead 90-1 of the primary power connection is connected to the lead 86A of the switch, and switch wire 86B is connected as the hot or live lead 88C of the motor drive signals 88. The common and ground connections of the primary and auxiliary power connections are as described above regarding the circuit configurations 80A and 80B. However, the hot lead 94B-1 of the auxiliary power connection is connected to the hot lead 90-1 of the primary power connection, and so the auxiliary power connection will be "hot" or active whenever the primary power connection is active or hot.

Figure 1B:
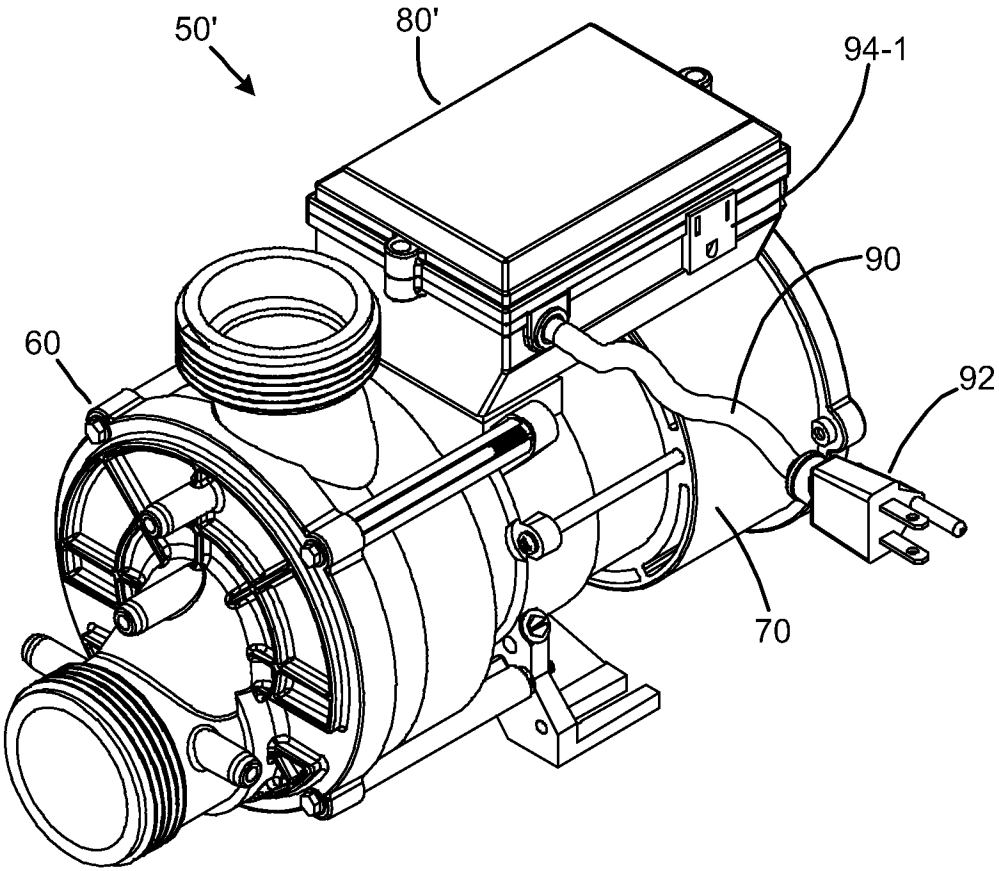
FIG. 1B is an isometric view of an alternate embodiment of a bathing installation water pump with an auxiliary power connection.

The auxiliary power connection can be a "pigtail" connection of a wiring cable and connector or plug attached to a distal end of the wiring cable. This power connection can include a mechanically secure connector at the sidewall of the module box 80, e.g. one which meets UL requirements with strain relief. Alternatively, the auxiliary power connection can include a female outlet plug mounted directly in a sidewall of the box 80, as illustrated in FIG. 1B, for example. The pump system 50' (FIG. 1B) is identical to system 50, except that the wiring cable 94B and female connector 94A have been replaced with a female outlet plug 94-1 in a sidewall of the module box 80'. The terminals of the plug 94-1 are connected to the wiring inside the box 80' in the same manner as described above with respect to the wires of the cable 94B.

Figure 3:
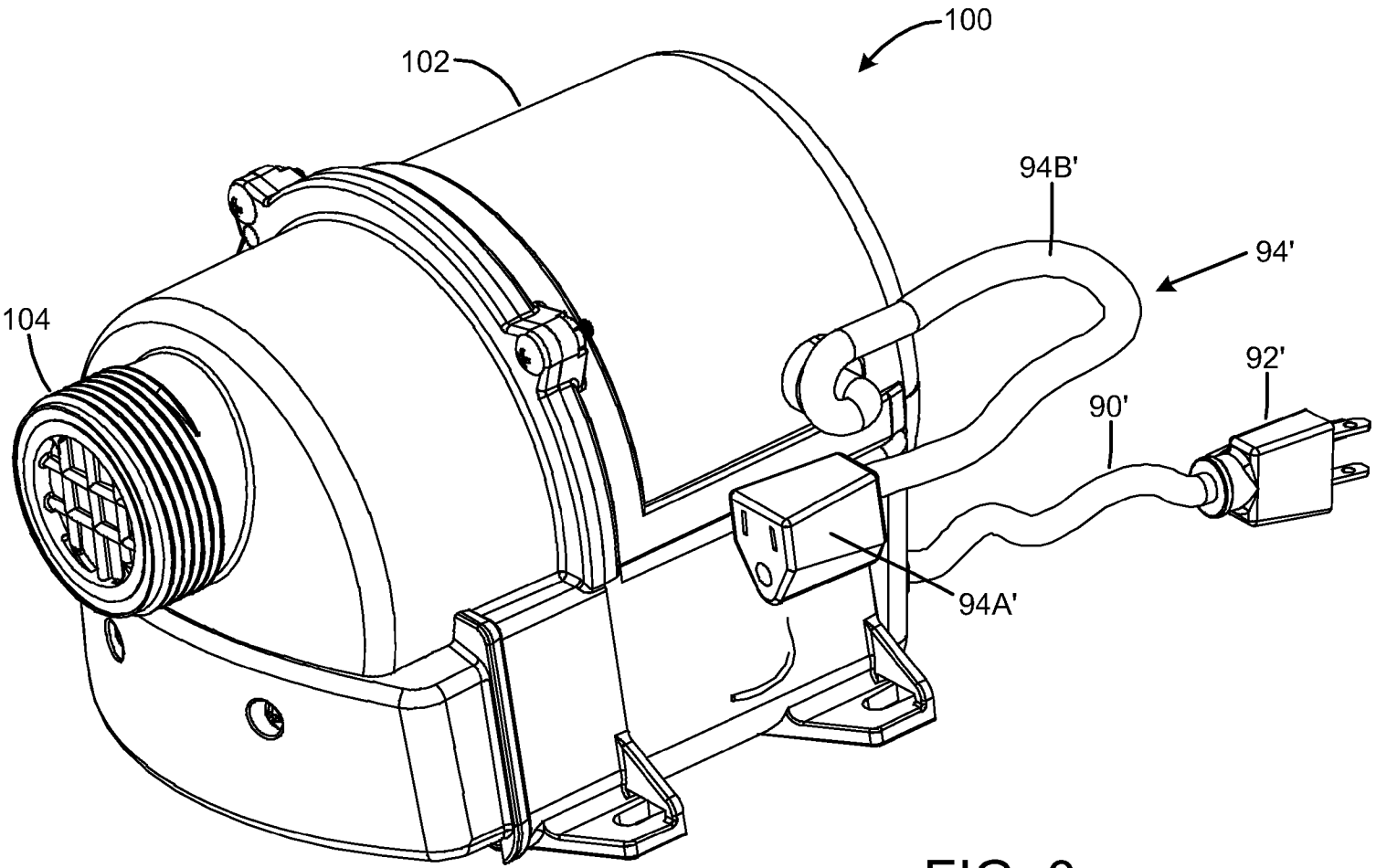
FIG. 3 is an isometric view illustrating an exemplary embodiment of an air blower for a bathing installation, with an auxiliary power connection.

The embodiments of FIGS. 1-2C have described a line voltage load device which is a motor-driven water pump for a bathing installation. In other embodiments, the line voltage load device may take other forms. For example, the line voltage load device may be an air blower 100 as illustrated in FIG. 3. In this case, the air blower has an outlet port 104 defined in housing 102, with the port for connection to an air delivery conduit system of a bathing installation. The air blower output may be connected to a set of jets, for example, in a bathing installation such as a spa or whirlpool bath. An exemplary air blower is described for example in pending U.S. application Ser. No. 11/961,888, the entire contents of which are incorporated herein.

In accordance with an aspect of this invention, the air blower 100 may include an auxiliary power connection 94' for connection to another device powered by line voltage. The air blower includes a primary power connection with power cord 90' and plug 94' configured in this exemplary embodiment for connection to a line voltage power outlet adjacent the bathing installation, to drive the blower electric motor. The air blower also includes the auxiliary power connection 94' with auxiliary cord 94B' and connector plug 94A' which is connected by a wiring circuit configuration analogous to that described above regarding FIGS. 2A-2C for the pump application, except that the wiring circuit will typically not include a capacitor for assisting in motor start-up. The auxiliary power connection can be switched on/off by an air switch with the operation of the blower, connected to line voltage when the blower motor is active on, or connected to line voltage independent of the switched condition of the blower motor drive. The circuitry for connection between the primary and auxiliary power connections can be disposed within the housing 102 of the blower, or in a utility box attached to the housing.

Figure 4A:
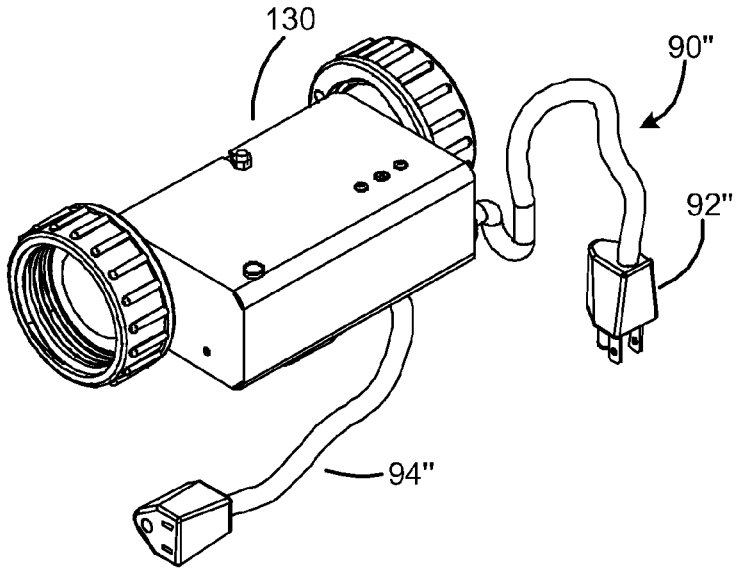
FIGS. 4A and 4B are respective isometric views of different exemplary embodiments of water heaters for bathing installation, each with an auxiliary power connection.
Figure 4B:
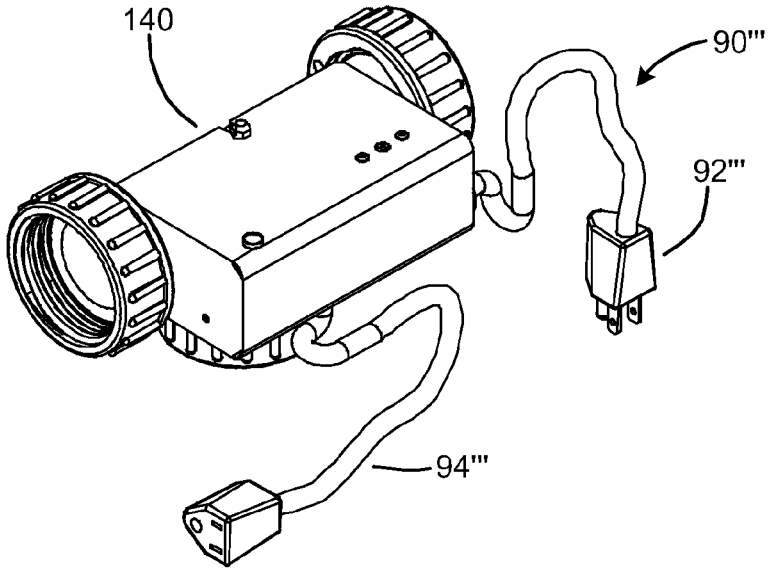

The line voltage load source may also be a water heater, connected in a water flow recirculating water flow line of a bathing installation. FIGS. 4A-4B illustrate two exemplary embodiments of a water heater with an auxiliary power connection. Each embodiment includes an electrically powered heater element, e.g. a resistive heater element. The heater element is powered by a primary line voltage power connection. The heater 130 of FIG. 4A is an in-line two port heater, with a primary line voltage power connection comprising wiring 90" and connector plug 92". The heater 130 includes an auxiliary line voltage power connection 94". The wiring configuration between the primary power connection and the auxiliary power connection is typically installed within the heater housing, and can take various forms. For example, the wiring configuration can be adapted so that the auxiliary power connection is switched on/off by a bathing installation pressure/vacuum switch, or by the heater electronic controller so that the auxiliary power connection is energized when the heater resistive element is energized. The primary power connection may take the form of a direct wiring connection to a terminal block on the bathing installation controller board in some cases. Exemplary devices which may be connected to the auxiliary power connection include an ozone generator or bathing installation lighting. FIG. 4B illustrates an exemplary embodiment of a three port water heater system 140, which includes a primary line voltage power connection including wiring 90''' and connection 92''', for connection to the line voltage source. The heater system 140 also includes an auxiliary power connection 94'''.

Figure 5:
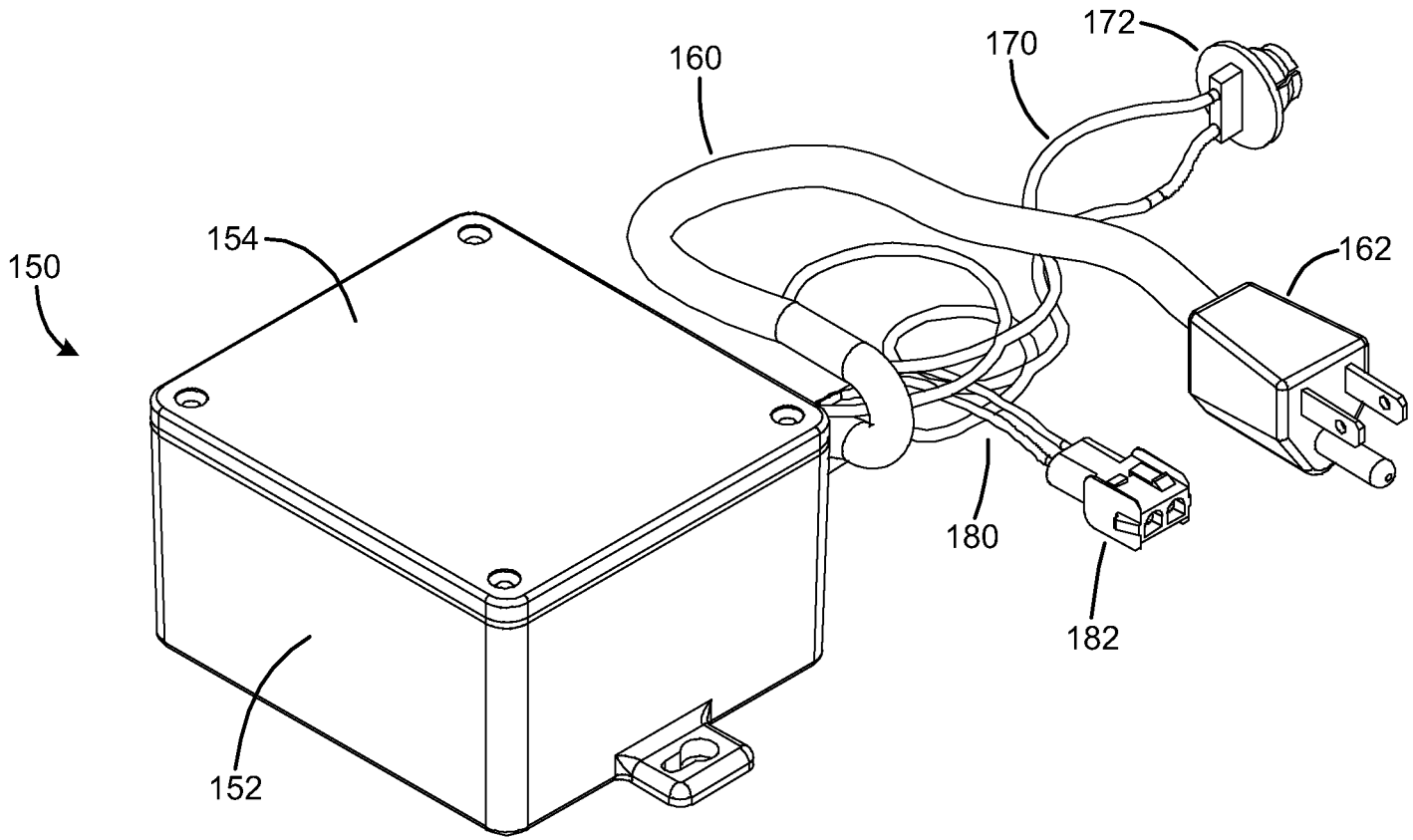
FIGS. 5 and 6 are isometric views illustrating an exemplary embodiment of a voltage transformer device having first and second low voltage output wiring sets.
Figure 6:
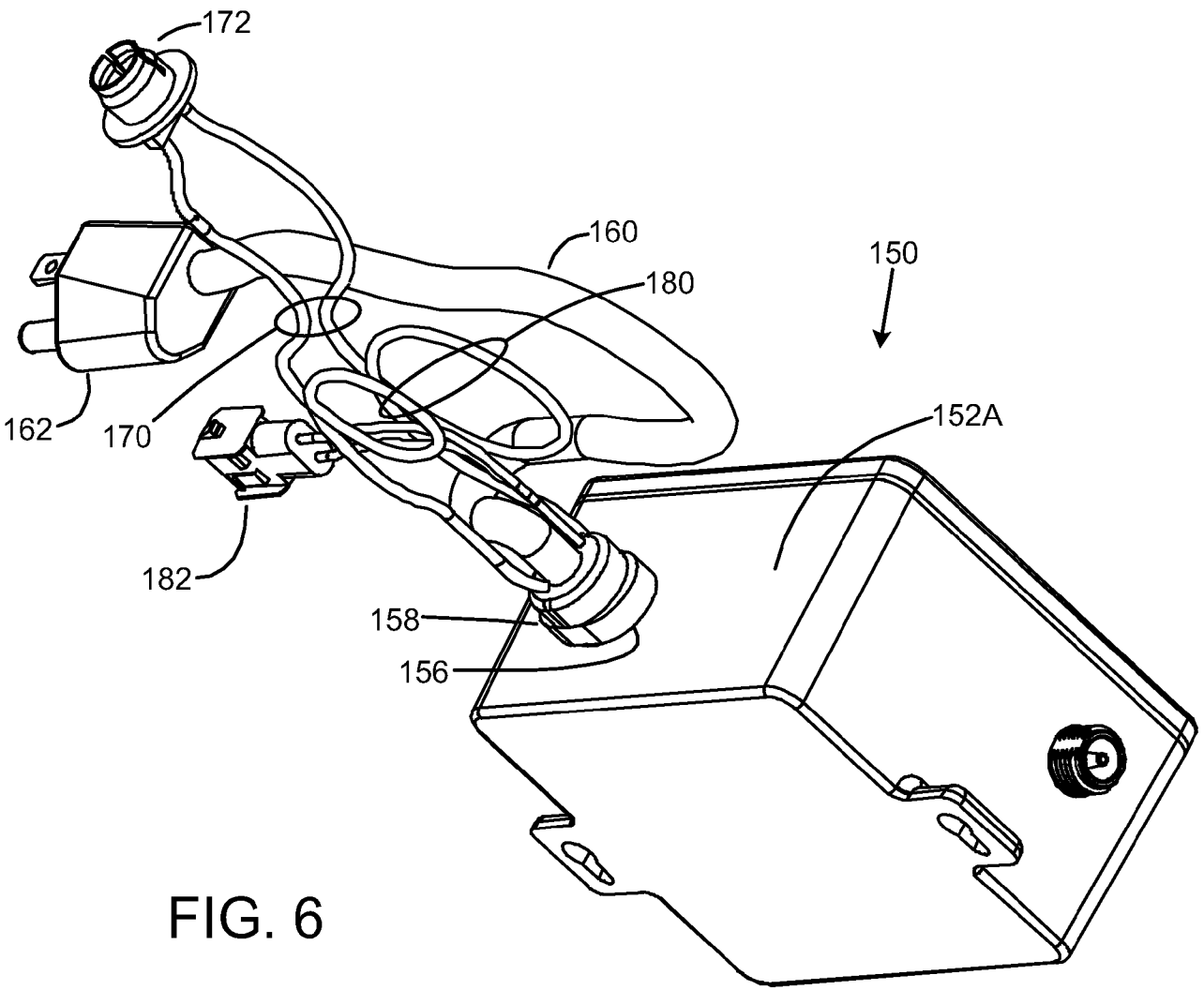
Figure 7:
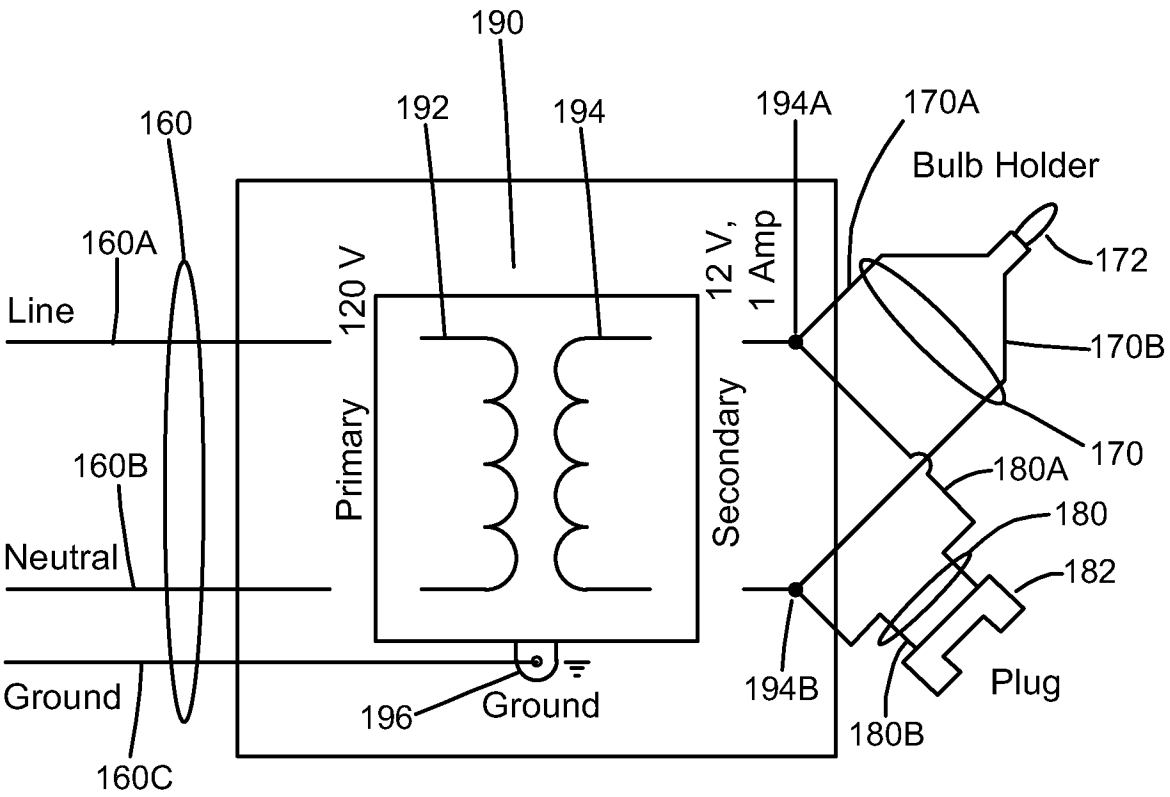
FIG. 7 is a schematic wiring diagram of a transformer circuit disposed in the housing of the voltage transformer device of FIGS. 5 and 6.

Another embodiment of a line voltage device with two power connections is illustrated in FIGS. 5-7. In this exemplary embodiment, a voltage transformer 150 is provided with dual low voltage outputs for powering two low voltage AC load devices or systems. The transformer includes a housing 152 with a removable cover 154 and side walls 152A.

A wiring port 156 is formed in one of the sidewalls to allow wiring to pass through the sidewall. In an exemplary embodiment, the wiring includes wiring 160 and connector plug 162, which is configured for connection to a line voltage outlet adjacent the bathing installation or to a line voltage load with an auxiliary power connection as illustrated above, e.g. in FIG. 1.

The wiring passed through the wiring port 156 further includes two wiring sets 170, 180 for providing low voltage AC power to low voltage bathing installation loads. For example, the first wiring set 170 is terminated in a light bulb holder fixture 172, which is configured to receive a light bulb in an operating configuration. The second wiring set 180 is terminated in a connector 182, configured to connect to a corresponding low voltage connector (not shown) for a low voltage light cable, powering several lights. Of course, other low voltage load options may be employed as well.

The wiring port 156 may be fitted with a grommet 158 to provide strain relief in an exemplary embodiment. The wirings 160, 170 and 180 may be passed through the grommet during assembly.

FIG. 7 illustrates an exemplary wiring schematic for the transformer 150. The transformer circuit 190 includes a primary winding 192 connected between the line conductor 160A and the neutral conductor 1608 of the line voltage wiring 160. The ground conductor 160C is connected to the transformer ground terminal 196. The transformer circuit further includes a secondary winding 194, configured to transform the 120V AC line voltage from wiring 160 to low voltage AC, in this example, 12V AC, on output terminals 194A, 1948, with a 1 ampere current rating. The respective wiring conductors 170A and 180A of wirings 170 and 180 are connected to output terminal 194A. The respective wiring conductors 170B and 180B of wirings 170 and 180 are connected to output terminal 194B. This exemplary transformer does not employ two secondary windings to deliver two low voltage outputs, thus providing the increased flexibility of two low voltage outputs from a single transformer in a bathing installation.

The transformer 150 can be configured to be always active when connected to line voltage. If connected to the auxiliary power outlet of the device of FIG. 1, the transformer can be controlled according to the respective one of the configurations illustrated in FIGS. 2A-2C. Alternatively, the transformer circuit can include an air-operated switch to connect either the line conductor 160A or neutral conductor 160B to the transformer primary winding. The air actuator can be mounted on a user-accessible location on or adjacent the bathing installation, and connected by a tube to the air-operated switch mounted in the housing 152, to provide another on/off switch option for the transformer.

Although the foregoing has been a description and illustration of specific embodiments of the subject matter, various modifications and changes thereto can be made by persons skilled in the art without departing from the scope and spirit of the invention.

What is claimed is:

1. A line voltage device with two output low voltage power connections for a bathing installation, comprising:

a housing structure;

a line voltage electrical power connection including a line voltage wiring cable having an electrical connection plug at a distal end for connection to a line voltage AC supply outlet adjacent the bathing installation;

a voltage transformer circuit disposed within the housing and connected to the line voltage wiring cable, the transformer circuit configured to transform AC line voltage from the line voltage electrical power connection to low voltage AC power at first and second low voltage AC terminals, wherein the low voltage AC power is delivered to the first and second low voltage AC terminals;

a first low voltage wiring set attached to the first and second low voltage AC terminals, the first wiring set including a first low voltage connector for electrical connection to a first separate low voltage bathing installation device to provide low voltage AC power to the first separate device;

a second low voltage wiring set attached to the first and second low voltage AC terminals, the second wiring set including a second low voltage connector for connection to a second separate low voltage bathing installation device to provide low voltage AC power to the second separate device; and wherein the line voltage device is free of circuitry for controlling or powering bathing installation devices which are not connected to said first or said second low voltage connector.

2. The line voltage device of claim 1, wherein the first low voltage connector includes a light bulb holder for mounting a light bulb.

3. The line voltage device of claim 1, wherein the second low voltage connector includes a low voltage AC connector configured for connection to a mating low voltage AC connector attached to a low voltage AC lighting circuit, and the first low voltage connector is a different type of connector from the second low voltage connector.

4. The line voltage device of claim 1, wherein the transformer circuit includes a primary winding and a secondary winding, said primary and secondary windings configured to transform 120 V AC to 12 V AC on the first and second low voltage AC terminals.

5. The line voltage device of claim 1, wherein the housing structure includes a wiring port, and said line voltage wiring cable, said first low voltage wiring set and said second low voltage wiring set are each passed through said wiring port of said housing structure.

6. The line voltage device of claim 1, wherein said voltage transformer circuit is configured to be always active when said electrical connection plug is connected to line voltage.

7. A line voltage device for a bathing installation, comprising:

a housing structure;

a line voltage electrical power connection including a line voltage wiring cable having an electrical connection plug at a distal end for connection to a line voltage AC supply outlet adjacent the bathing installation;

a voltage transformer circuit disposed within the housing and connected to the line voltage wiring cable, the transformer circuit configured to transform AC line voltage from the line voltage electrical power connection to low voltage AC power at first and second low voltage AC terminals, wherein the low voltage AC power is delivered to the first and second low voltage AC terminals;

a first low voltage wiring set attached to the first and second low voltage AC terminals, the first wiring set including a first low voltage connector for electrical connection to a first separate low voltage bathing installation device to provide low voltage AC power to the first separate device;

a second low voltage wiring set attached to the first and second low voltage AC terminals, the second wiring set including a second low voltage connector for connection to a second separate low voltage bathing installation device to provide low voltage AC power to the second separate device; and a single, manually operated switch device mounted in the housing structure and having an open circuit position and a closed position in which electrical continuity exists through the switch, the switch device connected in series between the line voltage wiring cable and the voltage transformer circuit and configured for directly interrupting line voltage from the line voltage wiring cable to the voltage transformer circuit in response to actuation of the switch device; and wherein, when the electrical connection plug is connected to line voltage, the voltage transformer circuit is connected to line voltage at all times, unless the switch device is in the open circuit position.

8. The line voltage device of claim 7, wherein the first low voltage connector includes a light bulb holder for mounting a light bulb.

9. The line voltage device of claim 7, wherein the second low voltage connector includes a low voltage AC connector configured for connection to a mating low voltage AC connector attached to a low voltage AC lighting circuit.

10. The line voltage device of claim 7, wherein the first low voltage connector is a different type of connector from the second low voltage connector.

11. The line voltage device of claim 7, wherein the transformer circuit includes a primary winding and a secondary winding, said primary and secondary windings configured to transform 120 V AC to 12 V AC on the first and second low voltage AC terminals.

12. The line voltage device of claim 7, wherein the housing structure includes a wiring port, and said line voltage wiring cable, said first low voltage wiring set and said second low voltage wiring set are each passed through said wiring port of said housing structure.

13. The line voltage device of claim 7, wherein the single, manually operated switch device includes an air switch receiver, the device further comprising a remote air switch actuator connected to the air switch receiver by an air tubing.

* * * * *